US010000360B2

(12) United States Patent
Stanton

(10) Patent No.: US 10,000,360 B2
(45) Date of Patent: Jun. 19, 2018

(54) RESIZABLE CORD HOLDER FOR STORING AND UNWINDING CORD BUNDLES

(71) Applicant: Martin P Stanton, Trinity, FL (US)

(72) Inventor: Martin P Stanton, Trinity, FL (US)

( * ) Notice: Subject to any disclaimer, the term of this patent is extended or adjusted under 35 U.S.C. 154(b) by 342 days.

(21) Appl. No.: 15/017,062

(22) Filed: Feb. 5, 2016

(65) Prior Publication Data

US 2016/0152437 A1 Jun. 2, 2016

Related U.S. Application Data

(63) Continuation-in-part of application No. 13/936,976, filed on Jul. 8, 2013, now Pat. No. 9,284,155.

(60) Provisional application No. 61/670,313, filed on Jul. 11, 2012.

(51) Int. Cl.

| | |
|---|---|
| ***B65H 75/44*** | (2006.01) |
| ***B65H 75/24*** | (2006.01) |
| ***B65H 49/30*** | (2006.01) |
| ***B65H 75/40*** | (2006.01) |

(52) U.S. Cl.

CPC ..... *B65H 75/4476* (2013.01); *B65H 49/30* (2013.01); *B65H 75/241* (2013.01); *B65H 75/406* (2013.01); *B65H 2701/34* (2013.01)

(58) Field of Classification Search

CPC ..... B65H 75/22; B65H 75/24; B65H 75/241; B65H 75/38; B65H 75/406; B65H 75/44; B65H 2701/34

See application file for complete search history.

(56) References Cited

U.S. PATENT DOCUMENTS

| | | | | |
|---|---|---|---|---|
| 1,252,483 A * | 1/1918 | Pattison | B65H 49/30 224/42.29 |
| 1,783,692 A * | 12/1930 | Bensema | B65H 75/20 242/577.3 |
| 2,138,299 A * | 11/1938 | Gruebel | B65H 49/30 242/127 |
| 4,687,154 A * | 8/1987 | Deweese | B65H 75/4476 242/401 |
| 7,395,985 B2 * | 7/2008 | Lazarro | B63B 21/04 242/401 |
| 9,284,155 B2 * | 3/2016 | Stanton | B65H 75/242 |

* cited by examiner

*Primary Examiner* — William E Dondero
*Assistant Examiner* — Nathaniel L Adams

(57) ABSTRACT

A resizable cord holder for storing and unwinding cord bundles has two elongated C-channel arms connected adjacent to each other to form a supporting base. The arms are connected to each other by a handle, which is installed into corresponding handle holes in the two arms. The total length of the supporting base can be adjusted by reselecting which holes the handle is installed into. The supporting base can rotate relative to the handle for unwinding an installed cord bundle. Cord bundles are held in place by two retainer mounts at opposite ends of the supporting base. A separation member of the retainer mounts traverses through the arms, connecting a locking member and a retainer member on opposite sides of the arms, with the locking members within the C-channels. Coil springs around the separation members apply retaining tension to the locking members against the inner surface of the C-channels.

12 Claims, 7 Drawing Sheets

RESIZABLE CORD HOLDER FOR STORING AND UNWINDING CORD BUNDLES

The current application is a continuation-in-part (CIP) application of U.S. patent application Ser. No. 13/936,976 filed on Jul. 8, 2013 which claimed priority to U.S. provisional application Ser. No. 61/670,313 filed on Jul. 11, 2012.

FIELD OF THE INVENTION

The present invention relates generally to a cord holder, more particularly to a resizable cord holder designed for storing and unwinding cord bundles.

BACKGROUND OF THE INVENTION

It is well known that a plurality of devices utilize long lengths of cord in order to extend their function. These devices may utilize the long lengths of cord as a means of receiving power but could also use the long lengths of cord as a mean of extending the reach of communicating with other devices through a plurality of means. Although the specific use of the long lengths of cord vary between various devices, the long lengths of cord are almost always wrapped in a cord bundle in order to conserve storage space. Typically, after a user is finished using a device, they would spool the long length of cord into a cord bundle by wrapping the long length of cord around the length of their forearm. The user would then remove their arm from the center of the cord bundle and place the cord for storage. While these cord bundles are a convenient means of organizing and storing long lengths of cord, the lack of a physical spool retaining the shape of the cord bundle makes them prone to entanglements upon unwinding.

Although the issue of entanglements upon unwinding a cord bundle is well known, adequate solutions for preventing entanglements are not readily available. The majority of the prior art describes apparatuses that prevent entanglements, but require the long length of cord to be initially spooled and stored on a particular apparatus or device in order to function properly. This pre-requisite hinders the functionality of the existing prior art and fails to provide an adequate solution for preventing entanglements upon unwinding an existing cord bundle.

It is therefore the object of the present invention to provide a resizable cord holder which is an apparatus that is designed to easily store pre-wound cord bundles and to prevent entanglements when unwinding an existing cord bundle.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced without the implementation of some features as they are described. It should be understood that some details have not been described in detail in order to not unnecessarily obscure focus of the invention.

The present invention is a resizable cord holder for storing pre-wound bundles of cord and unwinding said cord bundles. The present invention may be resized in order to fit various sizes of cord bundles.

Figure 1:
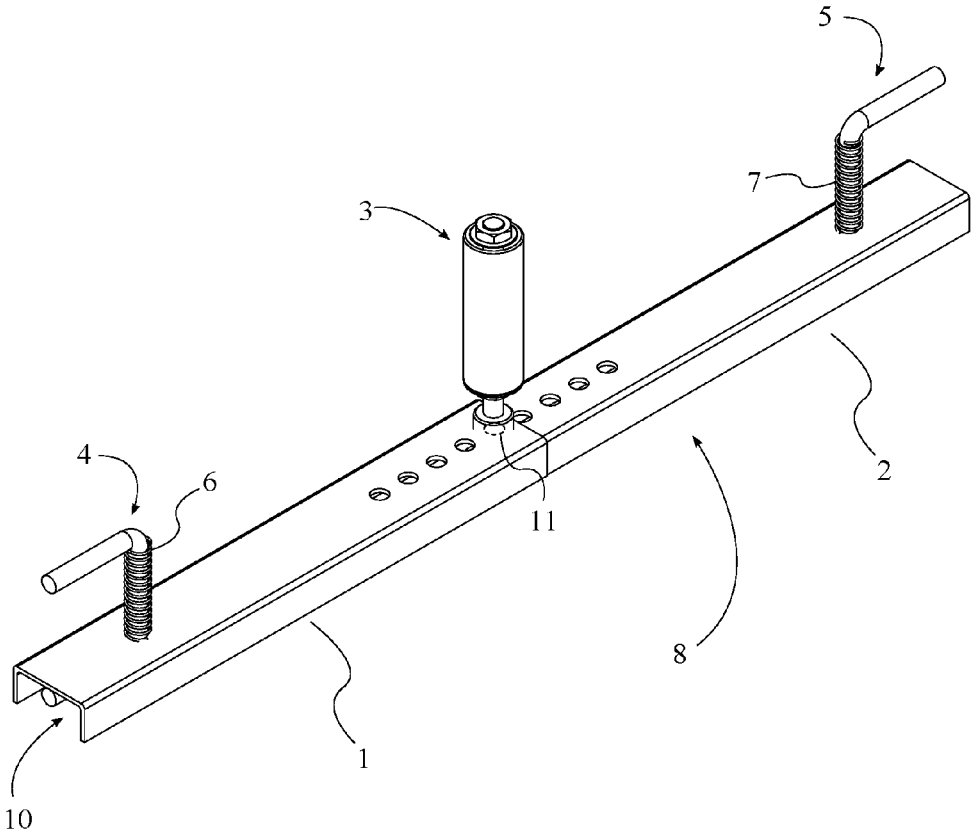
FIG. 1 is an elevated perspective view of the present invention.
Figure 2:
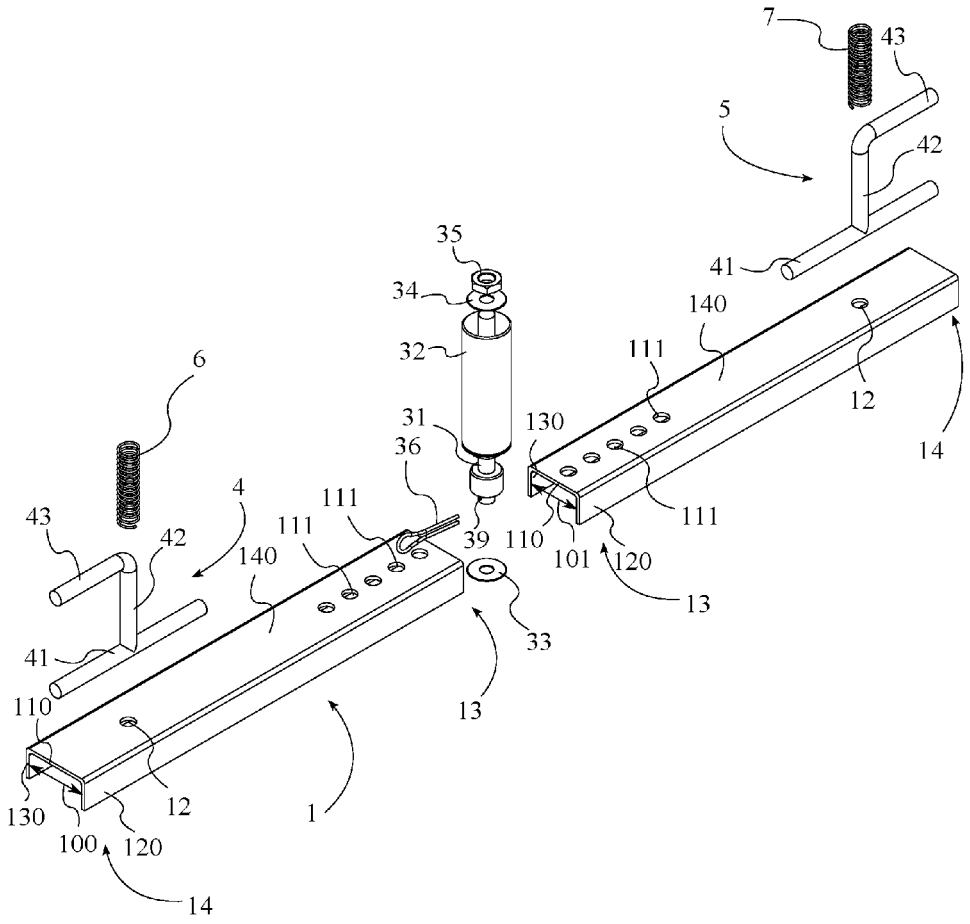
FIG. 2 is an exploded view of the present invention.

Referring to FIGS. 1-2, the present invention generally comprises a first arm 1, a second arm 2, a handle 3, a first retainer mount 4, a second retainer mount 5, a first coil spring 6, and a second coil spring 7.

The first arm 1 and the second arm 2 form the primary structure of the resizable cord holder. The first arm 1 and the second arm 2 are each elongated members, preferably made of a material such as, but not limited to, metal, a stiff polymer such as polyvinyl chloride or high-density polyethylene, or any other material or combination of materials which suits the purpose and spirit of the present invention. The first arm 1 and the second arm 2 are adjacently and linearly connected with each other, forming two halves of a supporting base 8. The first arm 1 and the second arm 2 each comprise a C-channel 10, at least one handle hole 11, and a retainer mount hole 12. More particularly, the second arm 2 is positioned within the C-channel 10 of the first arm 1. The C-channel 10 of the first arm 1 has a first arm width 100, and the C-channel 10 of the second arm 2 has a second arm width 101. Additionally, the first arm 1 and the second arm 2 further comprise a first end 13 and a second end 14, which are opposing extremities of the first arm 1 and the second arm 2. The handle hole 11, and more particularly the plurality of handle holes 111, is positioned adjacent to the first end 13 for both the first arm 1 and the second arm 2. Additionally, the retainer mount hole 12 is positioned a specified offset distance toward the handle holes 11 from the second end 14. The first arm 1 and the second arm 2 are generally identical, except that the first arm width 100 is different from the second arm width 101.

Figure 3:
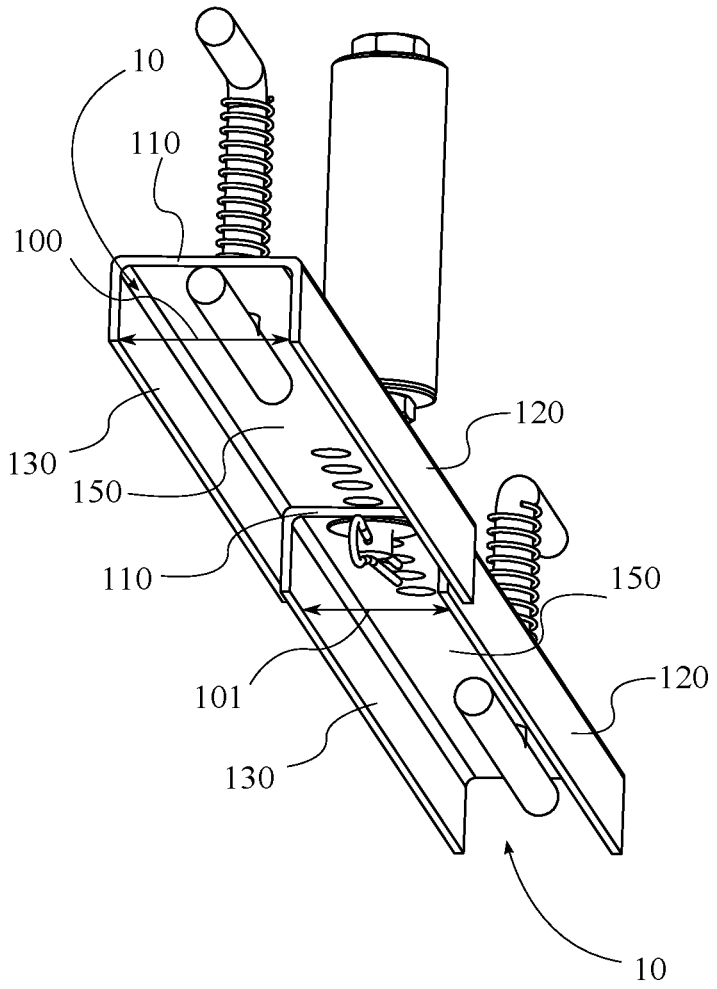
FIG. 3 is a lowered perspective view of the present invention.

Referring to FIGS. 2-3, more specifically, the C-channel 10 for both the first arm 1 and the second arm 2 comprises a central member 110, a first side member 120 and a second side member 130, and the central member 110 comprises an outer surface 140 and an inner surface 150. In the preferred embodiment of the present invention, the first side member 120 and the second side member 130 are positioned opposite each other on the inner surface 150 of the central member 110 and are perpendicularly connected to the inner surface 150 of the central member 110. It should be noted that a strict perpendicular angle between the side members and the central member 110 is not expressly required, but the side members should protrude from the central member 110 near perpendicular in order to adequately prevent the retainer mounts from substantially rotating during normal use.

The first arm width 100 is defined between the first side member 120 and the second side member 130 of the first arm 1, and the second arm width 101 is defined between the first side member 120 and the second side member 130 of the second arm 2. The first arm width 100 is greater than the second arm width 101, so that the second arm 2 fits within the C-channel 10 of the first arm 1 in order for the supporting base 8 to be resizable using the plurality of handle holes 111. The outer surface 140 of the C-channel 10 of the second arm 2 is positioned adjacent to the inner surface 150 of the C-channel 10 of the first arm 1. The first side member 120 and the second side member 130 of the C-channel 10 of the second arm 2 are positioned between the first side member 120 and the second side member 130 of the C-channel 10 of the second arm 2.

The retainer mount hole 12 of the first arm 1 is positioned opposite the at least one handle hole 11 of the first arm 1 along the first arm 1, and similarly the retainer mount hole 12 of the second arm 2 is positioned opposite the at least one handle hole 11 of the second arm 2 along the second arm 2. In the preferred embodiment of the present invention, the at least one handle hole 11 comprises a plurality of handle holes 111. The plurality of handle holes 111 of the first arm 1 are preferably patterned equidistantly from each other along the first arm 1 opposite the retainer mount hole 12 of the first arm 1, and similarly the plurality of handle holes 111 of the second arm 2 are patterned equidistantly from each other along the second arm 2 opposite the retainer mount hole 12 of the second arm 2. The plurality of handle holes 111 is distributed linearly and centrally on the first arm 1 and the second arm 2, and allows the supporting base 8 to be lengthened or shortened by connecting the first arm 1 and second arm 2 to each other by various different handle holes 11 and thus achieving different length and distance configurations relative to each other. Each handle hole 11 of the first arm 1 and the retainer mount hole 12 of the first arm 1 traverses through the central member 110 of the C-channel 10 of the first arm 1, and each handle hole 11 of the second arm 2 and the retainer mount hole 12 of the second arm 2 traverses through the central member 110 of the C-channel 10 of the second arm 2.

The handle 3 is rotatably coupled to the first arm 1 and the second arm 2 through the handle hole 11 of the first arm 1 and the handle hole 11 of the second arm 2. More particularly, in the preferred embodiment, the handle 3 is rotatably coupled to the first arm 1 and the second arm 2 through one of the plurality of handle holes 111 of the first arm 1 and one of the plurality of handle holes 111 of the second arm 2. The total length of the supporting base 8 formed by the conjunction of the first arm 1 and the second arm 2 may be variably established by choosing to connect the handle 3 into different handle holes 11. Connecting the handle 3 into the holes furthest away from the retainer mounts will result in the longest length of the supporting base 8, and connecting the handle 3 into the holes closest to the retainer mount holes 12 will result in the shortest length of the supporting base 8. Selection of the handle holes 11 to be used should be the same for both arms in order to maintain equidistance between the handle 3 and the two retainer mounts.

The first retainer mount 4 and the second retainer mount 5 are the components of the present invention which facilitate the storage of cord bundles. The first retainer mount 4 and the second retainer mount 5 are operatively engaged with the supporting base 8, being connected at extremities of the first arm 1 and a second arm 2, forming a span across which a cord bundle may be stored.

The first retainer mount 4 and the second retainer mount 5 each comprise an elongated locking member 41, a separation member 42, and a retaining member 43. In the preferred embodiment of the present invention, the elongated locking member 41, the separation member 42, and the retaining member 43 are embodied as stiff, strong elongated portions of material that form a structure resembling a lowercase letter "h," with the elongated locking member 41 corresponding to the longest, leftmost vertical portion of the "h," the retaining member 43 corresponding to the rightmost vertical portion of the "h,", and the separation member 42 corresponding to the horizontal portion of the "h" connecting the two lateral portions of the "h."

In the preferred embodiment of the present invention, the separation member 42 is perpendicularly connected to the elongated locking member 41 for both the first retainer mount 4 and the second retainer mount 5. The retaining member 43 is perpendicularly connected to the separation member 42, opposite the elongated locking member 41 along the separation member 42 for both the first retainer mount 4 and the second retainer mount 5. It should be understood that perpendicular connections between the components of the retainer mounts is not expressly and strictly necessary; however, the connection angles should be such that the functionality of the retainer mounts as described and the general shape of the lowercase letter "h" is preserved.

Additionally in the preferred embodiment, the retaining member 43 is removably attached to the separation member 42 for both the first retainer mount 4 and the second retainer mount 5, so that the retaining member 43 may be removed for either storage or removal of a cord bundle onto the present invention, or for maintenance. The separation member 42 of the first retainer mount 4 traverses through the retainer mount hole 12 of the first arm 1, and similarly the separation member 42 of the second retainer mount 5 traverses through the retainer mount hole 12 of the second arm 2. The elongated locking member 41 of the first retainer mount 4 has a length greater than the first arm width 100 of the C-channel 10 of the first arm 1, and the elongated locking member 41 of the second retainer mount 5 has a length greater than the second arm width 101 of the C-channel 10 of the second arm 2.

Figure 4:
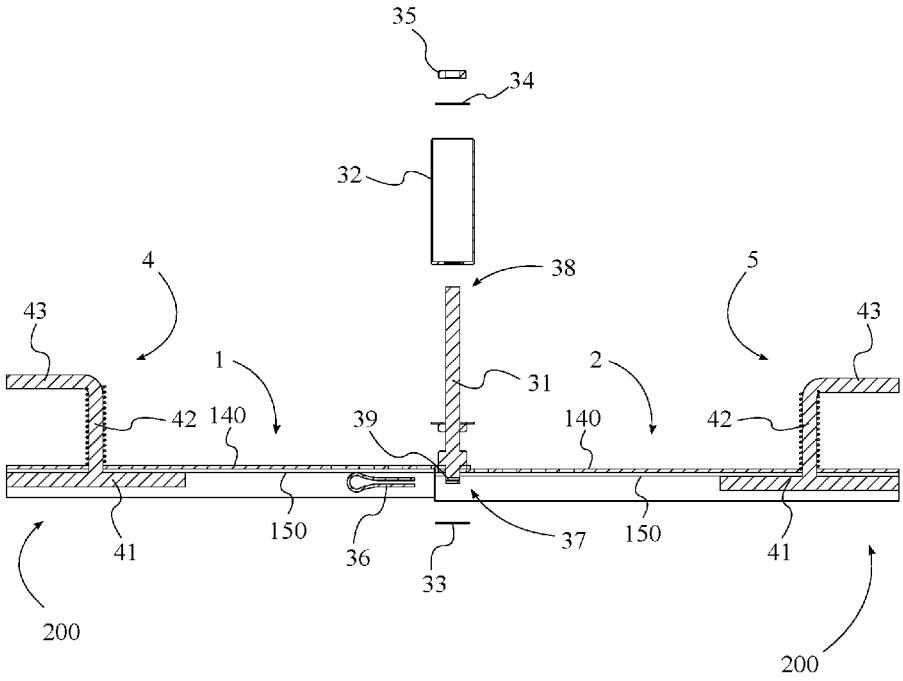
FIG. 4 is a side sectional, partially exploded view of the present invention.

Thus, as can be seen in FIG. 4, the first arm 1 is positioned between the elongated locking member 41 of the first retainer mount 4 and the retainer arm of the first retainer mount 4, and similarly the second arm 2 is positioned between the elongated locking member 41 of the second retainer mount 5 and the retainer arm of the second retainer mount 5. Stated differently, the elongated locking member 41 and the retainer arm of the first retainer mount 4 are found disposed on opposite sides of the first arm 1, and the elongated locking member 41 and the retainer arm of the second retainer mount 5 are found disposed on opposite sides of the second arm 2.

The first coil spring 6 is engaged around the separation member 42 of the first retainer mount 4 between the first arm 1 and the retainer arm of the first retainer mount 4, such that the first coil spring 6 presses against the retainer arm of the first retainer mount 4 and against the first arm 1. More particularly, the first coil spring 6 is positioned adjacent to and presses against the outer surface 140 of the first arm 1. The second coil spring 7 is similarly engaged around the separation member 42 of the second retainer mount 5 between the second arm 2 and the retainer arm of the second retainer mount 5, such that the second coil spring 7 presses against the retainer arm of the second retainer mount 5 and against the second arm 2. More particularly, the second coil spring 7 is positioned adjacent to and presses against the outer surface 140 of the second arm 2.

When the first retainer mount 4 is in a locked position, the elongated locking member 41 of the first retainer mount 4 is positioned within the C-channel 10 of the first arm 1. Similarly, when the second retainer mount 5 is in a locked position, the elongated locking member 41 of the second retainer mount 5 is positioned within the C-channel 10 of the second arm 2. More particularly, in the locked positioned the elongated locking member 41 of the first retainer mount 4 is positioned adjacent to the inner surface 150 of the first arm 1 and the elongated locking member 41 of the second retainer mount 5 is positioned adjacent to the inner surface 150 of the second arm 2. Thus, the first retainer mount 4 and the second retainer mount 5 are restrained against rotation due to the elongated locking member 41s being obstructed against rotation by the first side member 120 and the second side member 130 of the C-channel 10 shape of the first arm 1 and the second arm 2. The resizable cord holder of the present invention is designed to hold a bundle of cord when both the first retainer mount 4 and the second retainer mount 5 are in the locked position. The cord bundle is held against the separation members 42 of the first retainer mount 4 and the second retainer mount 5, between the supporting base 8 and the retaining member 43 of the first retainer mount 4 and the second retainer mount 5. The locked position may be a closed locked position 200 or an open locked position 220. In the closed locked position 200, the retainer arm points toward the second end 14, away from the handle 3. In the open locked position 220, the retainer arm points away from the second end 14, toward the handle 3. In both the closed locked position 200 and the open locked position 220, the retainer mount is restrained against rotation.

In order to easily install a cord bundle onto the present invention, a user would apply a force to one of the retainer mounts, compressing its associated coil spring and pressing the elongated locking member 41 past the lip of the C-channel 10. Once the elongated locking member 41 clears the lip of the C-channel 10, the retainer mount as a whole may be rotated in either direction, resulting in the elongated locking member 41 being oriented so as to traverse the first side member 120 and the second side member 130 of the C-channel 10, such as being oriented perpendicular to the C-channel 10 and perpendicular to the elongated locking member's 41 orientation in its original locked position. This substantially perpendicular orientation is a support position 210. In the support position 210, the elongated locking member 41 acts as a stabilizing leg so that the present invention may be placed upon the ground without risk of tipping over.

Figure 5:
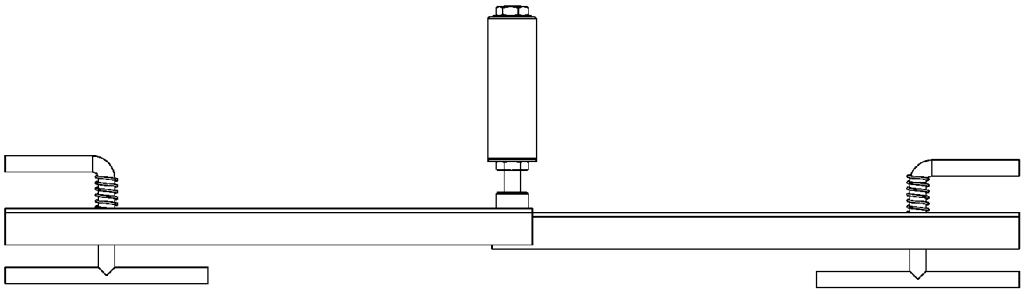
FIG. 5 is a side view showing the elongated locking members of the retainer mounts being depressed past the C-channels.
Figure 6:
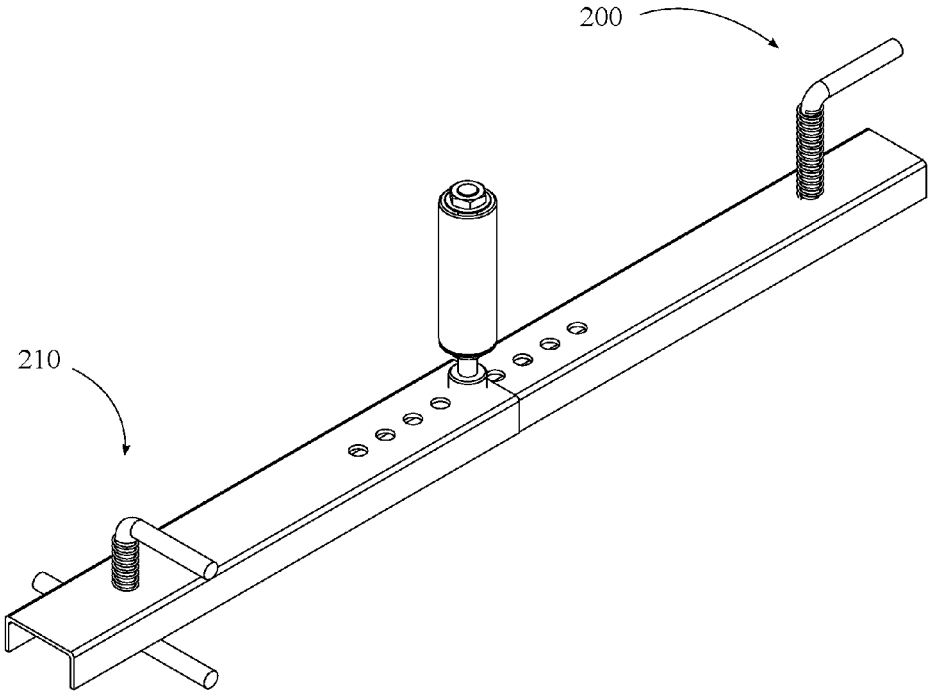
FIG. 6 is an elevated perspective view showing one of the retainer mounts in the support position.
Figure 7:
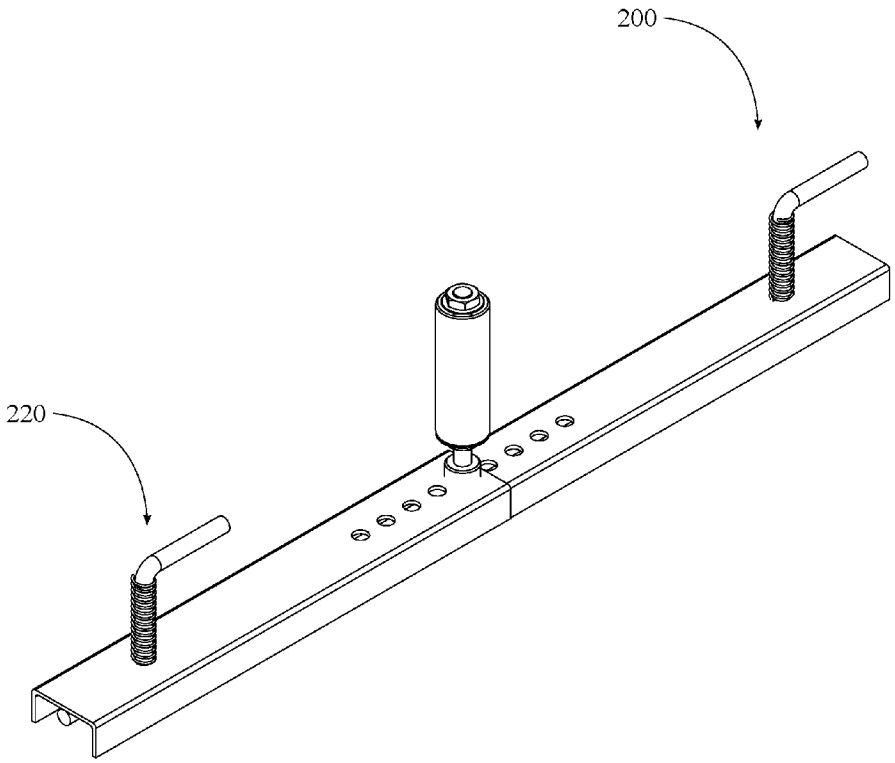
FIG. 7 is an elevated perspective view showing one of the retainer mounts in the open locked position.

The open locked position 220 of the retainer mounts is being rotated 180 degrees from the closed locked position 200, as opposed to 90 degrees of the support position 210. In the open locked position 220, the retaining member 43 is pointing toward the center of the bundle and no longer obstructing the cord bundle. A retainer mount in the closed locked position 200 may be said to be a closed retainer mount, while a retainer mount in the open locked position 220 may be said to be an open retainer mount. The user simply lifts the cord bundle away from the open retainer mount in order to remove the cord bundle without unwinding the cord bundle if so desired. In order to store a cord bundle, the user places one end of the cord bundle between a closed retainer mount of one arm and its respective arm, and then places the other end of the cord bundle over the opposite, unlocked retainer mount, wherein the unlocked retainer mount is in the support position 210, 90 degrees from the locked position, and proceeds to put said unlocked retainer mount back into the closed locked position 200 by turning the unlocked retainer mount 90 degrees back to the closed locked position 200. FIGS. 5-7 show the process of transitioning between the closed locked position 200, the support position 210 and the open locked position 220.

The first arm 1 and the second arm 2 are coupled to each other by the handle 3. The handle 3 is rotatably coupled to the first and second arm 2 through the handle holes 11 of the first and second arm 2, thus enabling the supporting base 8 to rotate relative to the handle 3. This is useful for unwinding a cord bundle being held by the present invention. The user grips the handle 3 with one hand, and with the other hand the user pulls on the free end of the cord, resulting in the cord bundle unwinding.

It is contemplated that there are many ways to couple the handle 3 to the supporting base 8, and any means may be utilized which accomplishes the aforementioned purpose. However, in the preferred embodiment of the present invention, referring to FIGS. 2 and 4, the handle 3 comprises a bolt 31, a shaft handle 32, a first disc bearing 33, a second disc bearing 34, a disc fastener 35, and a cotter key 36. The bolt 31 comprises a first rod end 37, a second rod and, and a cotter key hole 39. The cotter key hole 39 traverses laterally through the bolt 31 at the first rod end 37. The first rod end 37 of the bolt 31 traverses through the handle hole 11 of the first arm 1 and through the handle hole 11 of the second arm 2. The first disc bearing 33 is concentrically engaged around the bolt 31 adjacent to the second arm 2 between the cotter key hole 39 and the second rod end 38. The cotter key 36 traverses through the cotter key hole 39 adjacent to the first disc fastener 35 and opposite the second arm 2. The shaft handle 32 is preferably rotatably engaged around the second rod end 38 of the bolt 31. The second disc bearing 34 is concentrically positioned around the bolt 31 adjacent to the shaft handle 32 opposite the first rod end 37. The disc fastener 35 is concentrically engaged with the bolt 31 adjacent to the second disc bearing 34 so that the second disc bearing 34 is retained against the shaft handle 32 by the disc fastener 35.

Although the invention has been explained in relation to its preferred embodiment, it is to be understood that many other possible modifications and variations can be made without departing from the spirit and scope of the invention as hereinafter claimed.

What is claimed is:

1. A resizable cord holder for storing and unwinding cord bundles comprises:

a first arm;

a second arm;

a handle;

a first retainer mount;

a second retainer mount;

a first coil spring;

a second coil spring;

the first arm and the second arm each comprise a C-channel, at least one handle hole and a retainer mount hole;

the first retainer mount and the second retainer mount each comprise an elongated locking member, a separation member and a retaining member;

the retainer mount hole of the first arm being positioned opposite the handle hole of the first arm along the first arm;

the retainer mount hole of the second arm being positioned opposite the handle hole of the second arm along the second arm;

the second arm being positioned within the C-channel of the first arm;

the handle being rotatably coupled to the first arm and the second arm through the handle hole of the first arm and the handle hole of the second arm;

the separation member being perpendicularly connected to the elongated locking member for both the first retainer mount and the second retainer mount;

the retaining member being perpendicularly connected to the separation member, opposite the elongated locking member along the separation member for both the first retainer mount and the second retainer mount;

the separation member of the first retainer mount traversing through the retainer mount hole of the first arm;

the separation member of the second retainer mount traversing through the retainer mount hole of the second arm;

the elongated locking member of the first retainer mount having a length greater than a first arm width of the C-channel of the first arm;

the elongated locking member of the second retainer mount having a length greater than a second arm width of the C-channel of the second arm;

the first arm being positioned between the elongated locking member of the first retainer mount and the retainer arm of the first retainer mount;

the second arm being positioned between the elongated locking member of the second retainer mount and the retainer arm of the second retainer mount;

the first coil spring being engaged around the separation member of the first retainer mount between the first arm and the retainer arm of the first retainer mount, wherein the first coil spring presses against the retainer arm of the first retainer mount and against the first arm; and the second coil spring being engaged around the separation member of the second retainer mount between the second arm and the retainer arm of the second retainer mount, wherein the second coil spring presses against the retainer arm of the second retainer mount and against the second arm.

2. The resizable cord holder for storing and unwinding cord bundles in claim 1 comprises:

the elongated locking member of the first retainer mount being positioned within the C-channel of the first arm; and the elongated locking member of the second retainer mount being positioned within the C-channel of the second arm.

3. The resizable cord holder for storing and unwinding cord bundles in claim 1 comprises:

the at least one handle hole comprises a plurality of handle holes;

the plurality of handle holes of the first arm being distributed equidistantly from each other along the first arm opposite the retainer mount hole of the first arm; and the plurality of handle holes of the second arm being distributed equidistantly from each other along the first arm opposite the retainer mount hole of the second arm.

4. The resizable cord holder for storing and unwinding cord bundles in claim 1 comprises:

the retaining member being removably attached to the separation member for both the first retainer mount and the second retainer mount.

5. The resizable cord holder for storing and unwinding cord bundles in claim 1 comprises:

the first arm and the second arm each further comprise a first end and a second end, wherein the first end and the second end are opposing extremities of the first arm and second arm;

the handle hole being positioned adjacent to the first end; and the retainer mount hole being positioned a specified offset distance toward the handle hole from the second end.

6. The resizable cord holder for storing and unwinding cord bundles in claim 1 comprises:

the handle comprises a bolt, a shaft handle, a first disc bearing, a second disc bearing, a disc fastener, and a cotter key;

the bolt comprises a first rod end, a second rod end, and a cotter key hole;

the cotter key hole traversing laterally through the bolt at the first rod end;

the first rod end of the bolt traversing through the handle hole of the first arm and the handle hole of the second arm;

the first disc bearing being concentrically engaged around the bolt adjacent to the second arm between the cotter key hole and the second rod end;

the cotter key traversing through the cotter key hole adjacent to the first disc fastener opposite the second arm;

the shaft handle being rotatably engaged around the second rod end of the bolt;

the second disc bearing being concentrically positioned around the bolt adjacent to the shaft handle opposite the first rod end; and the disc fastener being concentrically engaged with the bolt adjacent to the second disc bearing, wherein the second disc bearing is retained against the shaft handle by the disc fastener.

7. The resizable cord holder for storing and unwinding cord bundles in claim 1 comprises:

the C-channel for both the first arm and the second arm comprises a central member, a first side member and a second side member;

the central member comprises an outer surface and a inner surface;

the first side member and the second side member being perpendicularly connected to the inner surface of the central member; and the first side member and the second side member being positioned opposite each other on the inner surface of the central member.

8. The resizable cord holder for storing and unwinding cord bundles in claim 7 comprises:

the elongated locking member of the first retainer mount being positioned adjacent to the inner surface of the first arm; and the elongated locking member of the second retainer mount being positioned adjacent to the inner surface of the second arm.

9. The resizable cord holder for storing and unwinding cord bundles in claim 7 comprises:

each handle hole of the first arm and the retainer mount hole of the first arm traversing through the central member of the C-channel of the first arm; and each handle hole of the second arm and the retainer mount hole of the second arm traversing through the central member of the C-channel of the second arm.

10. The resizable cord holder for storing and unwinding cord bundles in claim 7 comprises:

the first arm width being defined between the first side member and the second side member of the first arm;

the second arm width being defined between the first side member and the second side member of the second arm; and the first arm width being greater than the second arm width.

11. The resizable cord holder for storing and unwinding cord bundles in claim 7 comprises:

the outer surface of the C-channel of the second arm being positioned adjacent to the inner surface of the C-channel of the first arm; and the first side member and the second side member of the C-channel of the second arm being positioned between the first side member and the second side member of the C-channel of the first arm.

12. The resizable cord holder for storing and unwinding cord bundles in claim 7 comprises:

the first coil spring being positioned adjacent to the outer surface of the first arm; and the second coil spring being positioned adjacent to the outer surface of the second arm.

* * * * *